US005896836A

United States Patent [19]

Strauss et al.

[11] Patent Number: 5,896,836

[45] Date of Patent: *Apr. 27, 1999

[54] ARRANGEMENT IN CAMSHAFT ADJUSTERS FOR PREVENTING STARTING NOISES

[75] Inventors: Andreas Strauss, Herzogenaurach; Eduard Golovatal-Schmidt, Nurberg; Martin Scheidt, Adelsdorf, all of Germany

[73] Assignee: Ina Walzlager Schaeffler KG, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/894,998

[22] PCT Filed: Dec. 5, 1995

[86] PCT No.: PCT/EP95/04779

§ 371 Date: Aug. 18, 1997

§ 102(e) Date: Aug. 18, 1997

[87] PCT Pub. No.: WO96/26352

PCT Pub. Date: Aug. 29, 1996

[30] Foreign Application Priority Data

Feb. 20, 1995 [DE] Germany ..... 195 05 741

[51] Int. Cl.[6] ..... F01L 1/344

[52] U.S. Cl. ..... 123/90.17; 123/90.31; 74/568 R; 464/2; 464/160

[58] Field of Search ..... 123/90.12, 90.15, 123/90.17, 90.31; 74/568 R, 567; 464/1, 2, 160

[56] References Cited

U.S. PATENT DOCUMENTS

| | | | |
|---|---|---|---|
| 4,452,188 | 6/1984 | Kosuda et al. | 123/90.18 |
| 5,333,577 | 8/1994 | Shinojima | 123/90.15 |
| 5,421,294 | 6/1995 | Ruoff et al. | 123/90.17 |
| 5,509,383 | 4/1996 | Kahrs et al. | 123/90.17 |

FOREIGN PATENT DOCUMENTS

| | | |
|---|---|---|
| 4127327 | 2/1993 | Germany . |
| 4324987 | 2/1995 | Germany . |
| 2267583 | 12/1993 | United Kingdom . |
| WO9110813 | 7/1991 | WIPO . |
| WO9323656 | 11/1993 | WIPO . |

*Primary Examiner*—Weilun Lo

*Attorney, Agent, or Firm*—Bierman, Muserlian and Lucas

[57] ABSTRACT

A valve control device for an internal combustion piston engine adjusts positions of rotation of a camshaft relative to a crankshaft. This device comprises a hydraulic cylinder (1) comprising a piston (2) and at least one first feed duct (4). Between the cylinder (1) and a hydraulic pump (8), there is disposed a hydraulic valve arrangement (6) by which a hydraulic connection can be established between the first feed duct (4) and a first outlet duct. To assure a reliable prevention of rattling noises during the starting operation, it is proposed that the first outlet duct (10) open into a fluid reservoir (7) below the level of liquid therein.

1 Claim, 1 Drawing Sheet

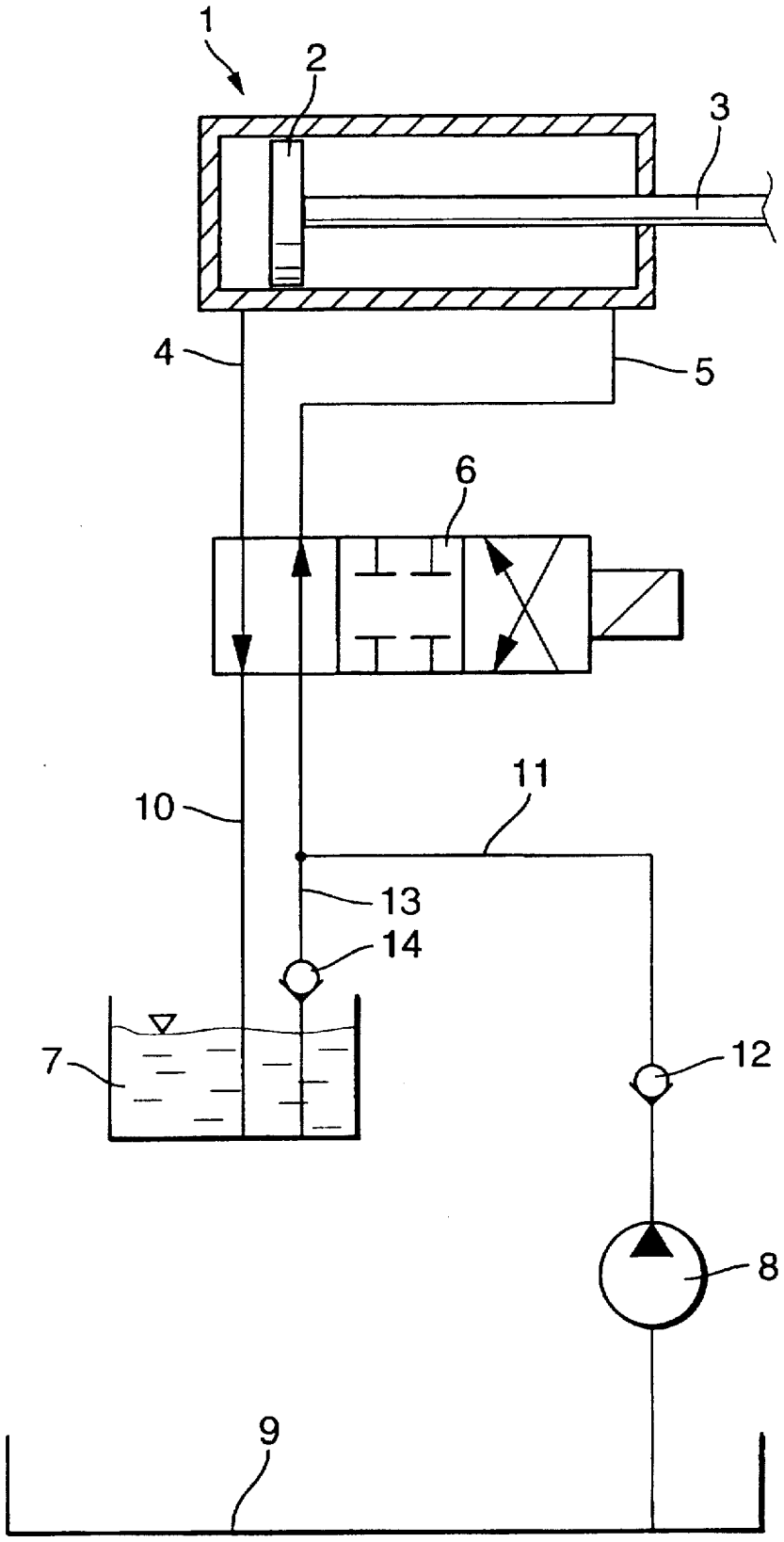
1
2
3
4
5
6
10
11
13
14
7
12
8
9

ARRANGEMENT IN CAMSHAFT ADJUSTERS FOR PREVENTING STARTING NOISES

DESCRIPTION

The invention concerns a device arranged on an internal combustion piston engine for adjusting positions of rotation of at least one camshaft relative to a crankshaft, said device comprising a hydraulic cylinder comprising a piston and a first feed duct, a hydraulic valve arrangement with which a hydraulic connection can be established between the first feed duct and a first outlet duct being disposed between said hydraulic cylinder and a hydraulic pump.

A device of the pre-cited type is known, for example, from WO-A-93/07362. Linear adjusting movements of the piston are converted by means of an adjusting member into rotary movements of a drive member relative to the camshaft. Rotations of the crankshaft are transmitted to the camshaft by the drive member. The drive member is normally a pinion driven by the crankshaft with the help of a chain. The adjusting member is arranged between this pinion and the camshaft. The adjusting member which is constituted, for example, by the piston and arranged concentric to the pinion and the camshaft, comprises a helical gearing and a spur gearing, said gearings cooperating with corresponding gearings associated to the camshaft and the pinion. On actuation of the hydraulic cylinder, the adjusting member is displaced axially relative to the pinion and the camshaft, and due to the helical gearing, a rotation of the camshaft takes place relative to the pinion.

In the prior art device, the first outlet duct opens into an oil pan so that fluid from the cylinder can flow into the oil pan. As described more closely below, the use of this prior art device can lead to the occurrence of rattling noises during the starting of the internal combustion piston engine. The hydraulic pump is normally driven by the internal combustion piston engine which cannot build up pressure during starting. If the engine is started after a long standstill, such a quantity of the fluid stored in the cylinder has leaked out that compressible gas cushions are formed in the cylinder. As a result, a linear movement of the piston guided in the cylinder is possible even when the pressure chambers of the cylinder are closed. Due to the above-mentioned helical gears, the alternating torques transmitted from the camshaft to the adjusting member exert axial forces on the adjusting member. Due to the compressible gas cushions, these axial forces cause oscillatory movements of the piston which migrates further towards one end of the cylinder and finally strikes against this end thus causing rattling noises by its oscillation.

It is an object of the invention to assure by simple means that such rattling nosies cannot occur.

The invention achieves the above object in that the first outlet duct opens into a fluid reservoir below the fluid level therein. In the one direction of movement of the oscillating piston, the gas eventually enclosed in the cylinder is displaced and pumped into the fluid reservoir from which it can escape. In the other direction of movement of the oscillating piston, fluid is sucked into the cylinder from the fluid reservoir. This prevents the piston from striking against an end of the cylinder. The undesired oscillatory movements of the piston are thus exploited for producing a pumping effect. Advantageously, the volumes of fluid or gas displaced between the cylinder and the fluid reservoir due to the piston displacements are larger than the capacity of the ducts between the cylinder and the fluid reservoir.

In an advantageous development of the invention, the first feed duct is arranged on one side of the piston and a second feed duct is arranged on the other side of the piston on the cylinder. Such double-action cylinders assure a reliable control of the adjusting movements of the piston.

In a particularly advantageous embodiment, the hydraulic valve arrangement is constituted by a 4/3 directional control valve. In a first operating position of the valve, hydraulic connection is established between the first feed duct and the fluid reservoir, and between the second feed duct and the hydraulic pump, while in a second operating position, hydraulic connection is established between the first feed duct and the hydraulic pump, and between the second feed duct and the fluid reservoir. In a third operating position, both feed ducts are shut off. The first or the second operating position is set during starting of the internal combustion piston engine with the already mentioned effects. These operating positions are also required during driving for varying rotational positions, the third operating position being set when no variation of the rotational position is required.

In a further advantageous embodiment, a second outlet duct is provided between the hydraulic valve arrangement and the hydraulic pump. This second outlet duct opens into the fluid reservoir below the fluid level therein and comprises a non-return valve which closes in the direction of the fluid reservoir. In the corresponding operating position of the hydraulic valve arrangement, the second feed duct is hydraulically connected both with the fluid reservoir through the second outlet and with the hydraulic pump so that, due to the pumping effect, fluid is additionally pumped into the cylinder through the second feed duct, a backflow of fluid into the fluid reservoir being prevented by the non-return valve. It is assured in this way that, due to the pumping effect, fluid is rapidly sucked to both sides of the piston, a backflow of fluid to the hydraulic pump through the second feed duct being reliably prevented by a further non-return valve. This further non-return valve closing in the direction of the hydraulic pump is arranged in a known manner on the delivery side of the hydraulic pump.

The invention will now be described more closely with the help of an example of embodiment illustrated in the sole figure.

A cylinder 1 comprises a piston 2 comprising an adjusting member 3. The adjusting member 3 is constituted, for example, by a sliding sleeve, not illustrated, which has a spur gearing on one peripheral surface and a helical gearing on a second peripheral surface, or has oppositely oriented helical gearings on the inner and outer peripheral surfaces. The sliding sleeve is normally arranged between a crankshaft-driven drive member and a camshaft, both not shown. A longitudinal displacement of the sliding sleeve caused by piston displacements leads to a change in the position of rotation of the camshaft relative to the crankshaft. The cylinder 1 comprises a first feed duct 4 and a second feed duct 5 both of which are hydraulically connected with a 4/3 directional control valve 6. A fluid reservoir 7 and a hydraulic pump 8 are likewise hydraulically connected with the 4/3 directional control valve 6. The hydraulic pump 8, which is driven by the crankshaft, is supplied with oil from an engine oil sump 9. The connection between the fluid reservoir 7 and the 4/3 directional control valve 6 is made by a first outlet duct 10 and the connection between the hydraulic pump 8 and the 4/3 directional control valve 6 is made by a duct 11 in which a non-return valve 12 closing in the direction of the hydraulic pump 8 is arranged. A second outlet duct 13 branches off from the duct 11 between the non-return valve 12 and the 4/3 directional control valve to open into the fluid reservoir 7. A non-return valve 14 is likewise installed in the second outlet duct 13 and closes in the direction of the fluid reservoir 7. Both outlet ducts 10, 13 open into the fluid reservoir 7 below the fluid level therein.

In the shown, first operating position of the 4/3 directional control valve 6, the first feed duct 4 is connected to the fluid reservoir 7 and the second feed duct 5 to the hydraulic pump 8. In the second operating position, the first feed duct 4 is hydraulically connected with the hydraulic pump 8 and the second feed duct 5 with the fluid reservoir 7. In a third operating position, both feed ducts 4, 5 are shut off so that the cylinder 1 is closed towards the outside. Starting of the internal combustion piston engine is effected in the shown, first operating position and is described more closely below.

During the starting operation of the internal combustion piston engine, the hydraulic pump builds up no, or only slight pressure. If starting follows a longer standstill, oil has flowed out of the cylinder 1 due to leakage so that gas cushions are formed which, however, are not specifically represented here. Torsional vibrations are produced as a result of alternating torques of the camshaft and are converted into oscillatory vibrations which are transmitted to the piston 2. The oscillating piston 2 migrates further towards the feed duct 4 whereby the existing gas cushions are pumped through the first feed duct 4 and the first outlet duct 10 into the fluid reservoir 7. Since the fluid reservoir 7 is an open vessel, the gas can escape freely. The oscillating movements of the piston 2 have the further effect that oil is sucked from the fluid reservoir 7 into the cylinder 1 through the first outlet duct 10 and the first feed duct 4 or through the second outlet duct 13 and the second feed duct 5, as the case may be. Before the piston 2 reaches the left end of the cylinder 1, so much oil has been pumped into the cylinder 1 that a striking of the piston 2 against the left end of the cylinder 1 is reliably prevented. Thus, rattling noises are eliminated.

It goes without saying, that arrangements are conceivable in which the 4/3 directional control valve is in the second operating position during starting. This is particularly appropriate if, by reason of the configuration of the adjusting member, the piston 2 migrates towards the right end of the cylinder 1. In this case, existing gas cushions are pumped into the fluid reservoir 7 through the second feed duct 5 and the second outlet duct 13. In addition, oil is pumped from the fluid reservoir 7 into the cylinder 1 through the two outlet ducts 10, 13. A sufficient quantity of oil has collected in the cylinder 1 before the piston 2 can strike against the right end of the cylinder 1.

We claim:

1. A device for adjusting positions of rotation of at least one camshaft relative to a crankshaft of an internal combustion engine, said device comprising a hydraulic cylinder (1) comprising a piston (2) and a first feed duct (4), a hydraulic valve arrangement (6) with which a hydraulic connection can be established between the first feed duct (4) and a first outlet duct (10) being disposed between said hydraulic cylinder (1) and a hydraulic pump (8), and hydraulic fluid from an oil sump (9) being transferred into the hydraulic cylinder (1) by the hydraulic pump (8) characterized in that the first outlet duct (10) opens into a fluid reservoir (7) below a fluid level thereof, the fluid reservoir (7) being arranged above the oil sump (9), whereby the volumes of fluid or gas displaced between the cylinder and the fluid reservoir due to the piston displacements are larger than the capacity of the ducts between the cylinder and the fluid reservoir, the first feed duct (4) is arranged on one side of the piston (2) and a second feed duct (5) is arranged on the other side of the piston (2) on the cylinder (1), the hydraulic valve arrangement is constituted by a 4/3 directional control valve (6), in a first operating position hydraulic connection is established between the first feed duct (4) and the fluid reservoir (7), and between the second feed duct (5) and the hydraulic pump (8), while in a second operating position, hydraulic connection is established between the first feed duct (4) and the hydraulic pump (8), and between the second feed duct (5) and the fluid reservoir (7), and in a third operating position, both feed ducts (4, 5) are shut off, a second outlet duct (13) is provided between the hydraulic valve arrangement (6) and the hydraulic pump (8), said second outlet duct (13) opening into the fluid reservoir (7) below the fluid level therein and comprising a non-return valve (14) which closes in the direction of the fluid reservoir (7).

* * * * *